US007987643B2

(12) United States Patent
Nugue et al.

(10) Patent No.: US 7,987,643 B2
(45) Date of Patent: Aug. 2, 2011

(54) MECHANICAL CONNECTING DEVICE FOR A SYSTEM THAT IS USED TO ATTACH ELEMENTS TO A STRUCTURE

(75) Inventors: Jean-Clément Nugue, Lamorlaye (FR); Georges Maublanc, Ouroux sur Saone (FR)

(73) Assignee: Saint-Gobain Glass France, Courbevoie (FR)

( * ) Notice: Subject to any disclaimer, the term of this patent is extended or adjusted under 35 U.S.C. 154(b) by 722 days.

(21) Appl. No.: 10/492,543

(22) PCT Filed: Oct. 23, 2002

(86) PCT No.: PCT/FR02/03626

§ 371 (c)(1),
(2), (4) Date: Sep. 30, 2004

(87) PCT Pub. No.: WO03/038222

PCT Pub. Date: May 8, 2003

(65) Prior Publication Data

US 2005/0055913 A1 Mar. 17, 2005

(30) Foreign Application Priority Data

Nov. 2, 2001 (FR) ..... 01 14700

(51) Int. Cl.
*E04H 1/00* (2006.01)

(52) U.S. Cl. ..... 52/235; 52/578

(58) Field of Classification Search ..... 52/235, 52/578, 733.4

See application file for complete search history.

(56) References Cited

U.S. PATENT DOCUMENTS

| | | | | |
|---|---|---|---|---|
| 5,540,514 | A * | 7/1996 | Demars et al. | 403/388 |
| 6,412,242 | B1 * | 7/2002 | Elmer | 52/235 |
| 6,467,227 | B2 * | 10/2002 | Elmer | 52/235 |

FOREIGN PATENT DOCUMENTS

| | | | |
|---|---|---|---|
| DE | 199 40 720 | | 3/2001 |
| DE | 10000417 | A1 * | 3/2001 |
| EP | 617 190 | | 9/1994 |
| EP | 1 020 577 | | 7/2000 |
| WO | 01/63082 | | 8/2001 |
| WO | 01/73251 | | 10/2001 |

* cited by examiner

*Primary Examiner* — Richard E Chilcot
*Assistant Examiner* — Branon C Painter
(74) *Attorney, Agent, or Firm* — Oblon, Spivak, McClelland, Maier & Neustadt, L.L.P.

(57) ABSTRACT

A system for fastening an element, particularly made of fragile material such as glass, to a bearing structure or a framework at least at one point. At least at one fastening point, the system includes a mechanical connection device for fixing the element to a framework or bearing structure or connecting to an adjacent similar element. At least one arm at a first end is connected to a fastener mechanically connected to the element, and at a second end is connected to a joining piece. The joining piece includes a tubular envelope that contains a mechanism for adjusting degrees of freedom of the fixing or of the connection. A wall including at least one fixed or opening element can be fixed to a structure or a framework by such a mechanical connection device.

49 Claims, 4 Drawing Sheets

MECHANICAL CONNECTING DEVICE FOR A SYSTEM THAT IS USED TO ATTACH ELEMENTS TO A STRUCTURE

The present invention relates to a system for fastening elements such as panels, particularly made of fragile material especially glass, to a structure such as an element of a carcass or to a framework such as posts or tensioned cables, at least at one point.

Among the applications of the present invention are the production of glazed partitions, walls or facades made up of glass elements fixed to the surrounding carcass elements (ceiling, floor, walls) and possibly joined together. These partitions, walls or facades may be made up of fixed or moving (doors, windows, ventilation hatches) glass elements. Conventionally, the fixtures for these elements act on drillings passing through the elements and comprise two pieces clamped against each of the faces of the elements.

To allow the relative positions of the elements and of the structure to be adjusted, the drillings are generally larger in size than the members inserted therein, so as to allow these members to be accommodated in a broad range, then the position of the members is fixed when the pieces are tightened, these pieces also serving to hide the gap between the members and the edges of the holes.

While admittedly these fixing solutions are effective, the presence of the opaque clamping pieces, which are generally metal plates, goes against the desire for transparency which caused glass to be chosen as a material from which to make the wall elements.

Fixing systems which favor transparency are known in the production of glazed facades made up of structural glazing (SG). The glazing therein is equipped with fastener or attachment devices which generally have, as a common element, an attachment shank projecting on the one side, at right angles or roughly at right angles to the glass panel, mounted on the panel via connecting means of any type, particularly pendular, of the ball-joint type, using bolts, etc. Advantageously, the connection means is such that the other side of the panel on the opposite side to the shank has no element protruding from the facade.

To allow glass panels, the size of which may be considerable, to be mounted accurately, the fastener systems generally comprise adjusting devices situated at the fasteners themselves, and which therefore remain visible. While that is not generally detrimental to the esthetic appearance of a large glazed assembly, it may become so in the case of smaller glazed elements such as glazed partitions.

The applicant company has looked for means of mechanical connection between an element and a support structure or a framework with the objective of such means allowing the elements made of glass or some other fragile material to be correctly positioned, and in particular to remain in their plane of inertia without introducing stresses associated with relative movements due to possible differences in thermal expansion, so that the material maintains all of its mechanical properties while at the same time best preserving the esthetic look of the fixing so as to make it applicable particularly to the production of small glazed volumes.

To this end, there is proposed, according to the invention, a device for mechanical connection between fastener and framework or structure which is able to form a break in the transmission of forces and which allows the fixing to have a position that is fixed at a number of degrees of freedom that is chosen particularly according to the position of the fastener because the stresses at the upper points and at the lower points of the system are not the same.

This mechanical connection device allows fine control over the relative movements of a joinery or facade assembly comprising glass elements (particularly monolithic or laminated glass, multiple glazing at least one panel of which may itself be laminated, etc.) or elements made of some other fragile material particularly ceramic, which in situ are subjected to high forces, whether these be elements of essentially flat shape such as panes or panels, or elements with some volume such as beams or posts.

The subject of the present invention is, first of all, a mechanical connection device for fixing an element, particularly made of fragile material such as glass, to a framework or bearing structure or connecting to an adjacent similar element, comprising at least one arm with a first end connected to a fastener connected to the element, and a second end connected to a joining piece, said joining piece comprising a tubular envelope which contains a mechanism for adjusting the degrees of freedom of the fixing or of the connection.

The device according to the invention decouples the functions of connection to the element and adjustment of the position thereof by relegating the adjustment mechanism to inside a joining piece which is offset with respect to the fastener. For this, the joining piece has a tubular envelope or sheath which shields the adjusting mechanism from view. The sheath may adopt very diverse shapes in order to conform to all architectural choices, and the term "tubular" here denotes a volume of any cross section (circular, elliptical or generally curved, but also square, rectangular or generally polygonal).

According to a particular and advantageous embodiment, the first end of the arm hides at least part of the fastener. In particular, the fastener may be housed in the body of the arm through the first end of the arm.

In particular, if the fastener has a threaded portion, the body of the arm may comprise a tapped portion which accommodates the threaded portion of the fastener. The tapped portion may consist of a tapped spacer piece, fixed to the body of the arm by screwing, particularly by means of a screw inserted into the spacer piece at the opposite end to the fastener; this system allows easy assembly and disassembly of the connection device and provides adaptability to suit fasteners of different diameters simply by interchanging the spacer piece.

The first end of the arm may also contain a fixing mechanism that works by mechanical engagement of the clip type, able to collaborate with the exterior surface of the fastener or with a special-purpose body such as a bushing mounted on any fastener, possibly threaded.

The first end of the arm may also have an interior surface able to constitute a flat bearing surface for part of the fastener connected to the element. This arrangement makes it possible to provide a more rigid connection and allows forces to be transmitted by the fastener over a wider area than that afforded by the connecting shank. This flat bearing surface may well be hidden, for example if it is provided inside the body of the arm.

Advantageously, the first end of the arm may be disengaged to come into contact with the element, if appropriate via an interface material. Thus, the arm delimits, with the surface of the element, a space which in particular allows a portion or all of the fastener to be hidden. Furthermore, the arm affords an additional flat bearing surface, this time for bearing on the element directly, and this contributes to the rigidity of the connection and to the reaction of the forces in the direction of the arm.

As a preference, the adjusting mechanism is designed to allow, once the device has been mounted, the second end of the arm to be moved in terms of translation or in terms of rotation along its axis or perpendicular to its axis, within fixed limits, with the possibility of restricting, extending so far as to eliminate, one degree of freedom or both degrees of freedom of said movement, at the same time as definitive adjustment of the position of said fastener along the corresponding axis is provided if this or these degrees of freedom is or are eliminated.

This adjusting mechanism may be incorporated into the connection between the second end of the arm and the joining piece. In particular, the second end of the arm may be engaged in a cavity in the joining piece, or vice versa.

According to a particular embodiment, the second end of the arm has an externally threaded portion and the cavity of the joining piece is tapped to allow the position of the second end to be adjusted along its axis by screwing.

According to another particular embodiment, the cavity is of a shape designed to allow the second end, which may be externally threaded, to slide along its axis.

According to another particular embodiment, the cavity is of a suitable shape to allow the second end of the arm some play perpendicular to its axis, in particular in translation or in rotation, and the adjusting mechanism may comprise at least one adjustable stop designed to limit the magnitude of this play. In particular, the stop may be formed by the head of a screw-runner, the threaded shank of which collaborates with a tapped hole made in the body of the second end of the arm. Furthermore, the second end of the arm may be in connection with the joining piece via a pin which acts as a pivot pin.

As an alternative, the adjusting mechanism comprises a means able to give the joining piece a degree of freedom in rotation about an axis perpendicular to the axis of the second end of the arm. In particular, this means may consist of an elastic ring arranged in the joining piece so that it is coaxial with the second end of the arm.

The joining piece may be formed of at least two assembled parts, possibly able to move or immobilized with respect to one another.

For connection to the structure, to the framework or to at least one element thereof, a connection piece for connecting to the framework or the bearing structure is advantageously mounted on the tubular envelope or the arm or arms. In particular, this connection piece may comprise a connecting part for connecting to a tube, a cable or a stiffener, said connecting part in particular being able to slide along the tube, the cable or the stiffener.

The connection device may comprise a number of arms each having a first end connected to a fastener mechanically connected to an element and a second end connected to one and the same joining piece.

The device may also comprise a connecting part for connecting to a structure, said connecting part incorporating a pivot pin about which the element can pivot with respect to the structure. In this case, it is preferable for the mechanical connection device to comprise at least three arms the first ends of which are not aligned, so as not to encourage torsional moments in the element.

The present invention also relates to a wall comprising at least one fixed or opening element mounted on a structure or a framework by means of a mechanical connection device as defined hereinabove.

This wall may advantageously be formed of elements connected at the periphery to the structure or to adjacent elements, by means of at least one gasket of predetermined size filling the space between an element and the structure or between an element and another adjacent element, if necessary of uniform size between all the elements, for example by means of a pre-extruded gasket, all the elements being suitably aligned by virtue of the adjusting system of the connection device.

As a preference, the elements are provided with fasteners mechanically connected to the elements, although connections by bonding are also conceivable. The fastener is advantageously connected in the thickness of the material of the element either in just part of the thickness within a blind hole or with all of the thickness in a through-hole. In both instances the invention allows discrete and strong mounting.

To better illustrate the subject of the present invention, some embodiments thereof depicted in the appended drawings will now be described by way of purely illustrative and nonlimiting examples.

In order to make these figures easier to understand, the various elements depicted are not strictly to scale.

Figure 1:
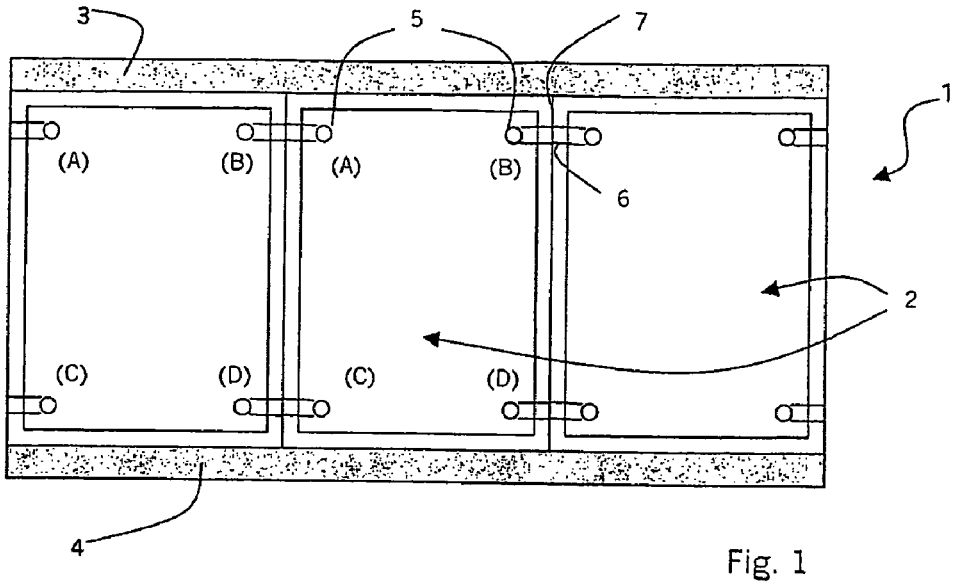
FIG. 1 is a partial diagrammatic view of a glazed partition.
Figure 6:
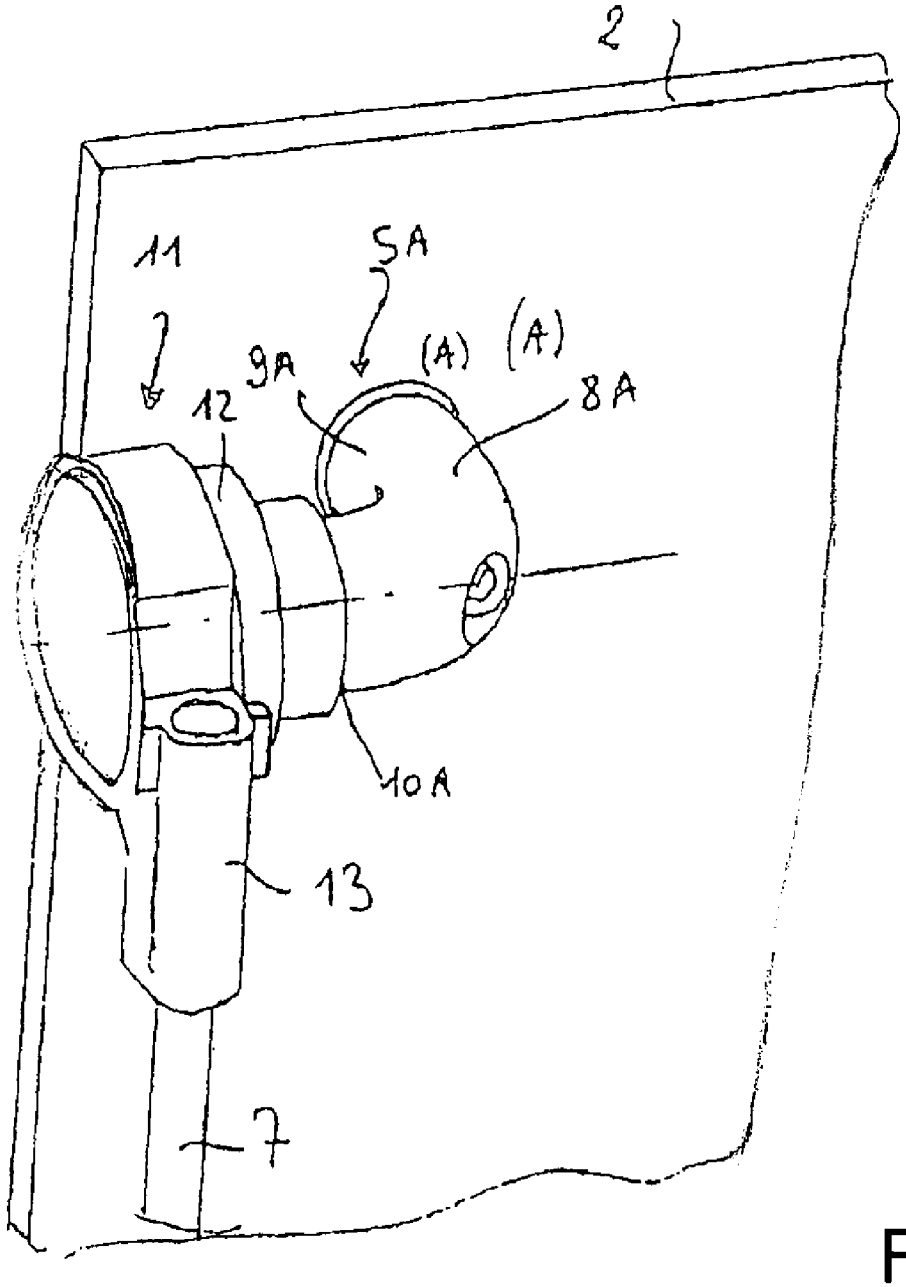
FIG. 6 is a perspective view of a connection device.

FIGS. 1 and 6 depict a vertical partition 1 made of glazed elements or windows 2 mounted between an upper level 3 and a lower level 4 of the carcass. For this, the windows 2 are equipped near each of their corners with fasteners 5 which collaborate with connection devices 6 for connection to a framework 7 here made of metal cables stretched between the upper 3 and lower 4 levels. A stiffening system or spine, not depicted, may be installed behind the framework to withstand the frontal loadings transmitted by the glazing to the framework.

In a common way, it is desirable for the fastener in position (A) to constitute a fixed point of the glazing and therefore be positioned very precisely during mounting without any degrees of freedom. For the purposes of mounting, the connection of the fastener at position (B) with the structure is preferably with a possibility of adjustment along a horizontal axis contained in the plane of the glazing, and the connection of the fasteners at positions (C) and (D) with the structure is preferably with a possibility of adjustment also along a horizontal axis contained in the plane of the glazing and also along a vertical axis contained in the plane of the glazing.

Figure 2:
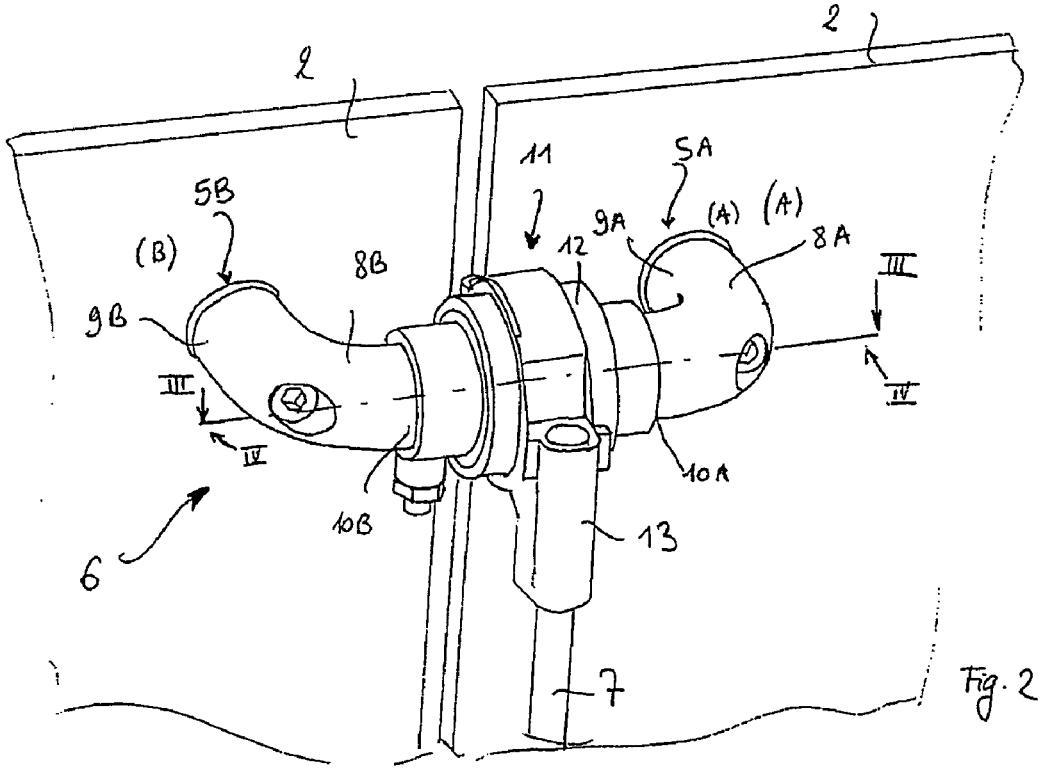
FIG. 2 is a perspective view of a connection device depicted in FIG. 1.

The device according to the invention which allows these adjustments is visible in the perspective view of FIG. 2, of a connection device for the connection of two adjacent elements between a position (B) and a position (A).

The device is essentially made up of two arms 8A and 8B, essentially in the shape of an L and collaborating on the one hand at a first end 9 respectively with the fasteners 5A and 5B and, on the other hand, at a second end 10 with a joining piece 11. This joining piece is gripped by a ring 12 which has a tubular part 13 arranged vertically for connection to the framework of cables 7. The cables 7 may just as easily be arranged behind the connection device 6 as depicted in the figure as between the connection device 6 and the glazing 2.

The arms 8 intercept the fasteners 5 of the glazings 2 in a direction which is transversal, generally normal, to the planes of the glazing 2, thus allowing very discrete mounting. The mechanisms for adjusting the fixing positions (A) and (B) are incorporated inside the joining piece 11 and are themselves invisible from the outside of the system.

Figure 3:
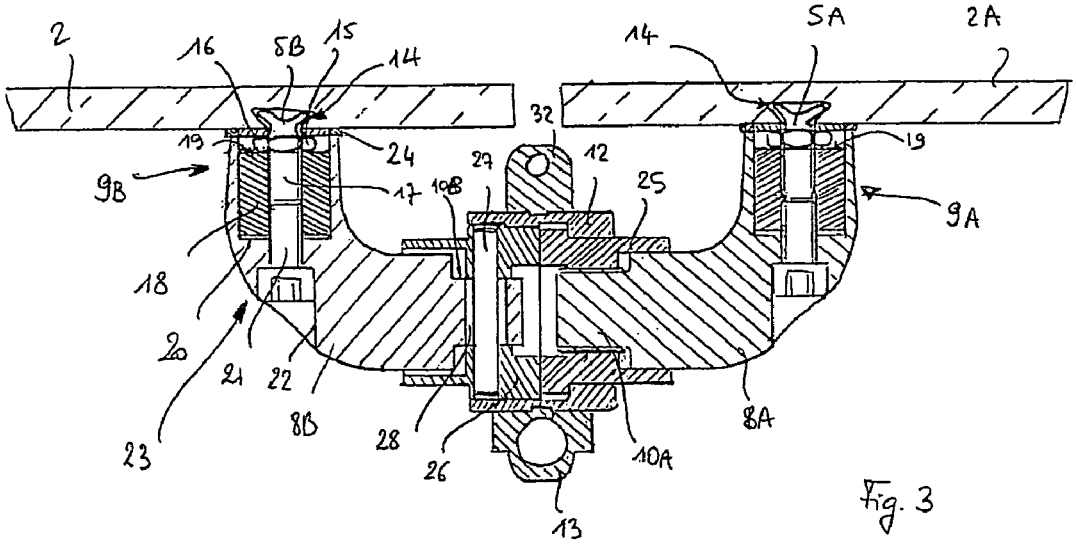
FIG. 3 is, on a larger scale, a part view in cross section on III-III of a glazed element of FIG. 2.

The details of the device are visible in FIG. 3 which is a view in section on III-III of FIG. 2.

This sectioned view schematically shows the structure of the fasteners 5, which are preferably expanding metal fasteners mechanically connected to a blind hole 14 with an undercut. Such fasteners are known in particular from documents EP 595 062 and EP 647 760. If appropriate, an interface material is arranged between the jaws of the fastener 5 and the wall of the milled hole 14. The fastener 5 is screwed to the glazing 2 by means of a nut 15 with the interposition of a washer 16.

As an alternative, the fastener 5 may be inserted into a through-hole, or may even be bonded in.

The part of the fastener 5 which serves for connection to the structure advantageously consists of a threaded shank 17 projecting at right angles to the surface of the glass 2.

The arms 8 of the connection device are preferably made of metal, particularly steel. The first end 9 of the arm 8 contains a tapped annular spacer piece 18 which accommodates the threaded shank 17. On its face situated on the same side as the glazing 2, the spacer piece 18 bears flat against the nut 15. On the opposite side to the face 19, the spacer piece 18 may bear flat against a shoulder 20 made inside the arm 8. The spacer piece 18 is clamped in the arm 8 by means of a screw 21 inserted in the tapping via a hole 22 made in the arm at the elbow 23 towards the first end 9. This flat bearing system allows the thread on the rod to be relieved when forces are transmitted. During mounting, the clamping operation has the effect of bringing the first end 9 of the arm to bear against the surface of the glazing 2, if necessary via an interface material 24, such as a silicone washer. This material may be placed in a groove made in the frontal surface of the spacer piece or the end of the arm, and held there as a tight fit or by a connection of the clip type. The fact that the end of the arm bears against the glazing 2 allows the fastener to be completely hidden and causes the arm to contribute to the transmission of forces and relieves the mechanical fastener.

The spacer piece system makes it possible, using the same type of arm, to tailor the device to suit fasteners of different types, that is to say having a connection shank that may or may not be threaded, or with different diameters, simply by replacing the spacer piece with another with an appropriate tapping and/or incorporating another system of connection to the shank, particularly by clipping.

As shown in the embodiments of FIGS. 2 and 6, at its second end 10A, the arm 8A, has an external screw thread. The joining piece 11 has a tapped portion 25 which collaborates with the threaded end 10A and which is free to turn inside the ring 12. This screw connection allows the position of the fastener 5A to be fixed precisely and definitively in a horizontal direction along the axis of the arm at the second end 10A.

The position of the fastener 5A, which serves as a fixed point in the glazing system, can be adjusted in terms of height at the connection between the part 13 and the cable 7, particularly by virtue of an adjustable tightening means of the nut type.

As shown in the embodiment of FIG. 2, at its second end 10B, the arm 8B has an unthreaded exterior surface. The joining piece 11 has a portion 26 screwed into the ring 12 and having a bore of a suitable shape that it can accommodate said end portion with axial sliding. Advantageously, the axial sliding is permitted by flat contact surfaces (yokes) between the second end 10B and the portion 26 parallel to the direction of translation. This connection in axial sliding makes it possible to manage the desired degree of freedom at the position of the fastener 5B in horizontal translation along the axis of the arm at the second end 10B.

The possibility of adjustment in the vertical direction is afforded by a pin 27 inserted horizontally into the joining piece portion 26 and which passes through the end 10B. For that, the end 10B is provided with a slot 28 which is wider than the diameter of the pin, so as to preserve the mobility in sliding.

Figure 4:
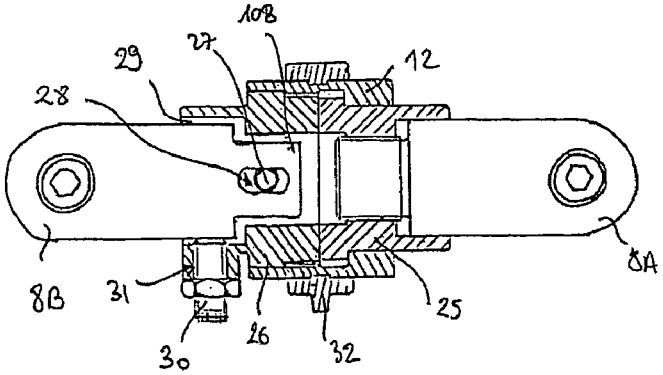
FIG. 4 is a part view in cross section on IV-IV of FIG. 2.

Other details are visible in FIG. 4 which is a sectioned view of FIG. 2 on IV-IV.

It can be seen that the joining piece portion 26 has a recess 29 which defines vertical play for the arm portion 8B near the end 10B which is free to turn about the axis of the pin 27. The magnitude of this clearance may be determined by an adjustable stop consisting of a screw runner 30 which passes through the body of the joining piece via a vertical hole 31. Once mounted, the glazing 2 is subject to the action of its self-weight and the arm 8B spontaneously comes into abutment against the head of the screw runner 30, and the possibility of turning is barred by the force of gravity. Adjusting the screw-runner therefore makes it possible to determine precisely the vertical position of the fastener 5B.

To constitute the connection of the fasteners 5C and 5D to the structure with two degrees of freedom in orthogonal translation, all that is required is to dispense with the screw-runners 30 forming stops, thus maintaining the possibility of vertical sliding of the end portions 9 of the arms 8.

This degree of freedom in rotation of the arms 8 about a horizontal axis may also be allowed by measures taken on the joining piece only, particularly through the fact that the two portions 25 and 26 of the joining piece 11 are separated by an annular ring of elastic material arranged coaxially with the holes in said portions. The joining piece portions 25 and 26 may be secured by virtue of the outer ring 12 forming a tubular envelope, the joining piece portion 26 also being surrounded by an elastic sleeve which allows limited vertical mobility.

A collar 32 is associated with the ring 12 and on this collar is provided the tubular part 13 for the connection to the vertical cable 7, particularly allowing the cable to slide in the tubular part.

The tubular part 13 may also be equipped with means of connection to a stiffener, particularly made of glass, behind the cable 7, with the possibility of sliding along the axis of the stiffener. Such a type of relationship between a connection device and a stiffener is described in EP 887 484.

The system which has just been described allows the mounting of elements such as glazing with very fine positioning, in particular allowing vertical and horizontal alignment with perfect uniformity, thus allowing the use of prefabricated extruded gaskets in order to achieve a durable seal between two adjacent elements. By comparison with the customary technique which consists in applying a jointing compound between the mounted elements, which is not always able to obtain perfect seals, the solution using prefabricated gaskets allows the esthetic dimension in producing the glazed assembly to be taken to new heights.

Figure 5:
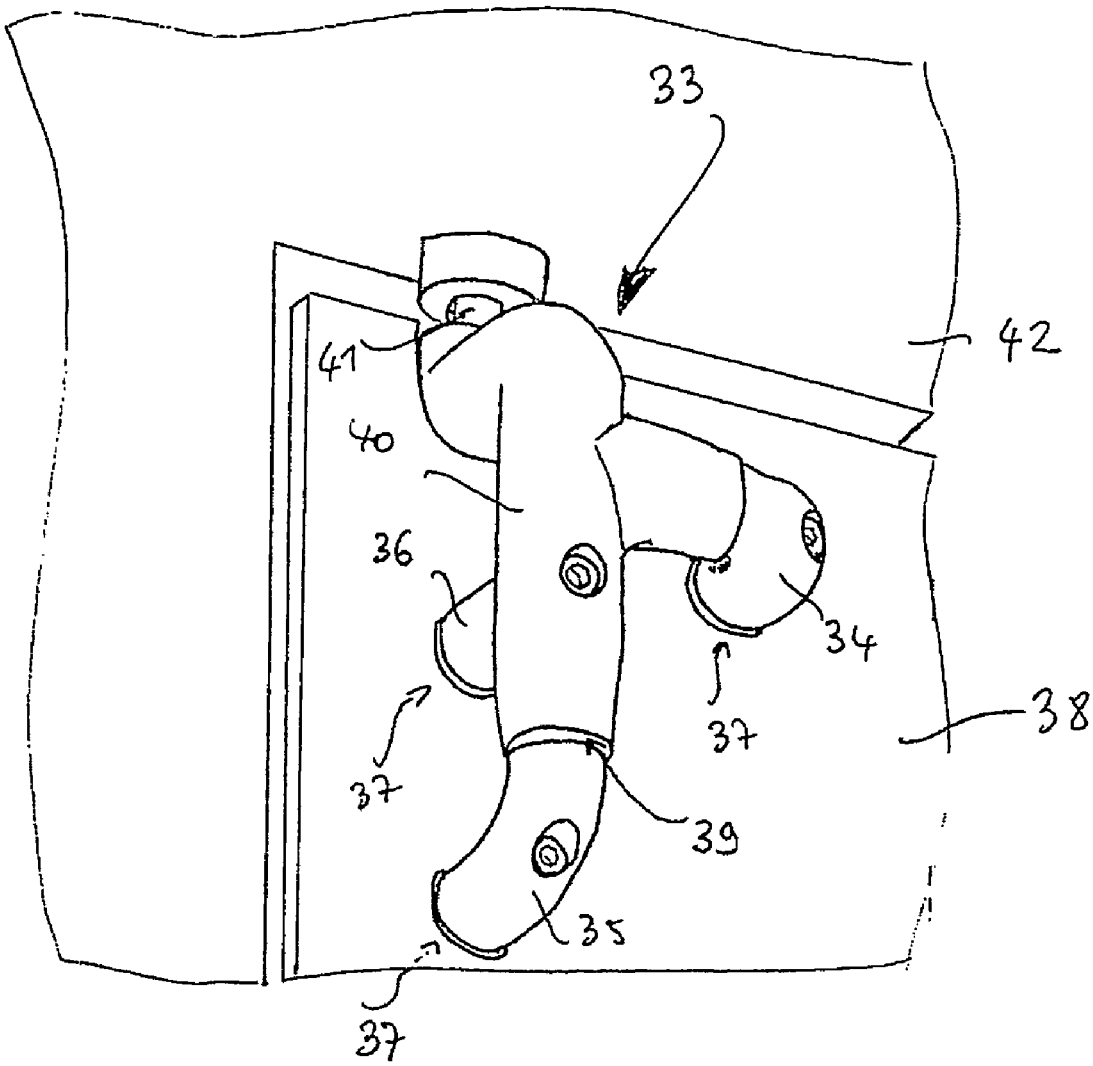
FIG. 5 is a schematic perspective view of the attachment of a glass door.

FIG. 5 depicts another embodiment of the invention which consists of a device for securing a glass door.

This device 33 is essentially made up of:

three arms 34, 35, 36 each having an end connected to a spot fastener 37 mechanically connected to the door panel 38 and another end connected to a joining piece 39 included in a tubular envelope 40, and a shaft 41 in pivoting connection with a carcass element 42 on the one hand and connected to the joining piece 39 or to the tubular envelope 40 on the other.

The three fasteners 37 are arranged on the door panel 38 at three points which are not aligned so as to avoid having a torsional moment in the glass. In the alternative form depicted, the two arms 34 and 35 are elbowed as in the previous embodiment, while the arm 36 is straight.

The shaft 41 is arranged in the plane of the door panel by virtue of an appropriate cut-out therein, which gives the door a double opening action. If the pivot were installed outside of the plane of the panel, the door would have a single opening action.

The pivot system is suited to the fixing of opening glazing with pivoting about a horizontal axis.

It goes without saying that the invention is not restricted to monolithic glazing. It also encompasses multiple glazing of the double glazing type in which the various glass panes are assembled via a gas-filled gap using a peripheral gasket, and laminated glazing such as glazing made up of a so-called "inner" pane of soda-lime silica float glass assembled with another, so-called "outer" pane of the same kind of glass, via an interlayer of plastic of the polyvinyl butyral type. Multiple glazing may also comprise at least one sheet of glass of the laminated type.

Of course, the embodiments described hereinabove are not in any way limiting and may give rise to any desirable modifications without thereby departing from the scope of the invention.

The invention claimed is:

1. A mechanical connection device for fixing an element to a framework or bearing structure by a fixing or connecting to an adjacent similar element by a connection, comprising:

a first arm and a second arm, a first end of each arm connects to a fastener configured to be mechanically connected to a respective element, and a second end of both the first and second arms connects to a same joining piece, wherein the joining piece comprises a tubular envelope that contains an adjusting mechanism configured to adjust degrees of freedom of the fixing or of the connection, wherein the adjusting mechanism is configured to allow, once the device has been mounted, the second end of the second arm to be moved both in translation and in rotation along its axis or perpendicular to its axis, within fixed limits, wherein the second end of the first arm has an externally threaded portion and the cavity of the joining piece is tapped to allow a position of the second end to be adjusted along a longitudinal axis of the second end by screwing, wherein a longitudinal axis of the second end of the first arm is substantially coaxial with a longitudinal axis of the second end of the second arm, and wherein each fastener is housed along a longitudinal axis of a body of the first end of each arm, the longitudinal axis being substantially perpendicular to a plane of the respective element and each fastener is adjustable along the longitudinal axis.

2. The mechanical connection device as claimed in claim 1, wherein the first end of each arm hides a fastener.

3. The mechanical connection device as claimed in claim 2, wherein the first end of each arm has an interior surface that includes a flat bearing surface configured to contact a part of the fastener connected to the element.

4. The mechanical connection device as claimed in claim 1, wherein the fastener comprises a threaded portion and the body of each arm comprises a tapped portion that accommodates the threaded portion of the fastener.

5. The mechanical connection device as claimed in claim 4, wherein the tapped portion comprises a tapped spacer piece fixed to the body of the arm by a screw inserted into the spacer piece at an opposite end to the fastener.

6. The mechanical connection device as claimed in claim 1, wherein the body of each arm includes a clip mechanism configured to collaborate with an exterior surface of the fastener or with a body mounted on the fastener.

7. The mechanical connection device as claimed in claim 1, wherein the first end of each arm is configured to come into contact with the element, if necessary by an interface material.

8. The mechanical connection device as claimed in claim 7, wherein the first end of each arm comprises a surface configured to constitute a flat bearing surface for bearing against the element.

9. The mechanical connection device as claimed in claim 1, wherein the adjusting mechanism is configured to at least restrict one degree of freedom or two degrees of freedom of movement, at a same time as definitive adjustment of the position of the fastener along the corresponding axis is provided if this or these degrees of freedom is or are eliminated.

10. The mechanical connection device as claimed in claim 1, wherein the second end of each arm is engaged in a cavity of the joining piece.

11. The mechanical connection device as claimed in claim 10, wherein the cavity is of a shape configured to allow the second end to slide along its axis.

12. The mechanical connection device as claimed in claim 10, wherein the cavity is of a suitable shape to allow the second end of the first arm some play perpendicular to its axis and the adjusting mechanism comprises at least one adjustable stop configured to limit a magnitude of the play.

13. The mechanical connection device as claimed in claim 12, wherein the stop is formed by a head of a screw-runner, a threaded shank of which collaborates with a tapped hole made in a body of the second end of the first arm.

14. The mechanical connection device as claimed in claim 12, wherein the adjusting mechanism comprises means for giving the joining piece a degree of freedom in rotation about an axis perpendicular to the axis of the second end of the first arm.

15. The mechanical connection device as claimed in claim 14, wherein the means for giving comprises an elastic ring arranged in the joining piece to be coaxial with the second end of the arm.

16. The mechanical connection device as claimed in claim 14, wherein the joining piece is formed of two assembled parts, configured to move or immobilized one with respect to the other.

17. The mechanical connection device as claimed in claim 1, further comprising a connection piece configured to connect to the framework or the bearing structure mounted on the tubular envelope or one arm.

18. The mechanical connection device as claimed in claim 17, wherein the connection piece comprises a connecting part for connecting to a tube or a cable or a stiffener.

19. The mechanical connection device as claimed in claim 18, wherein the connecting part is configured to slide along the tube or the cable or the stiffener.

20. The mechanical connection device as claimed in claim 1, wherein the tubular envelope has a connecting part for connecting to a structure, the connecting part incorporating a pivot pin about which the element can pivot with respect to the structure.

21. The mechanical connection device as claimed in claim 20, comprising at least three arms, the first ends of the at least three arms not being aligned.

22. A wall comprising at least one fixed or opening element fixed to a structure or a framework by a mechanical connection device as claimed in claim 1.

23. The wall as claimed in claim 22, wherein the element or elements are provided at their periphery with at least one gasket of predetermined size filling a space between an element and the structure or between an element and another adjacent element.

24. The wall as claimed in claim 22, wherein the elements are equipped with fasteners connected with drillings that may or may not pass through the elements.

25. The mechanical connection device as claimed in claim 1, wherein the longitudinal axis of the second end of the first arm is maintained substantially coaxial with a longitudinal axis of the second end of the second arm when the second end of each arm is connected to the same joining piece.

26. A mechanical connection device for fixing a panel element to a framework or bearing structure by a fixing or for connecting a panel element to an adjacent similar panel element by a connection, comprising:

at least one arm with a first end connected to a fastener mechanically connected to the panel element, and a second end connected to a joining piece, wherein the joining piece comprises a tubular envelope that contains an adjusting mechanism configured to adjust the degrees of freedom of the fixing or of the connection, wherein the second end of the arm is engaged in a cavity of the joining piece, said cavity being of a shape configured to allow the second end to be adjusted along a longitudinal axis of the second end, wherein the second end of the arm has an externally threaded portion and the cavity of the joining piece is tapped to allow a position of the second end to be adjusted along its longitudinal axis by screwing, and wherein said longitudinal axis of the second end is substantially parallel to the plane of the panel element.

27. The mechanical connection device as claimed in claim 26, wherein the first end of the arm hides the fastener.

28. The mechanical connection device as claimed in claim 27, wherein the first end of the arm has an interior surface configured to constitute a flat bearing surface for a part of the fastener connected to the panel element.

29. The mechanical connection device as claimed in claim 27, wherein the fastener is housed in a body of the arm through the first end of the arm.

30. The mechanical connection device as claimed in claim 29, wherein the fastener comprises a threaded portion and the body of the arm comprises a tapped portion that accommodates the threaded portion of the fastener.

31. The mechanical connection device as claimed in claim 30, wherein the tapped portion comprises a tapped spacer piece fixed to the body of the arm by screwing, by a screw inserted into the spacer piece at an opposite end to the fastener.

32. The mechanical connection device as claimed in claim 29, wherein the body of each arm comprises a clip mechanism configured to collaborate with an exterior surface of the fastener or with a body mounted on the fastener.

33. The mechanical connection device as claimed in claim 26, wherein the first end of each arm is configured to come into contact with the panel element, if necessary by an interface material.

34. The mechanical connection device as claimed in claim 33, wherein the first end of the arm comprises a surface configured to constitute a flat bearing surface for bearing against the panel element.

35. The mechanical connection device as claimed in claim 26, wherein the adjusting mechanism is configured to allow, once the device has been mounted, the second end of the arm to be moved in translation or in rotation along its longitudinal axis or perpendicular to its longitudinal axis, within the fixed limits, and is configured to restrict, extending so far as to eliminate, one degree of freedom or two degrees of freedom of the movement, at a same time as definitive adjustment of the position of the fastener along the corresponding axis is provided if this or these degrees of freedom is or are eliminated.

36. The mechanical connection device as claimed in claim 26, wherein the cavity is of a suitable shape to allow the second end of the arm some play perpendicular to its longitudinal axis and the adjusting mechanism comprises at least one adjustable stop configured to limit a magnitude of the play.

37. The mechanical connection device as claimed in claim 36, wherein the stop is formed by a head of a screw-runner, a threaded shank of which collaborates with a tapped hole made in a body of the second end of the arm.

38. The mechanical connection device as claimed in claim 36, wherein the adjusting mechanism comprises means for giving the joining piece a degree of freedom in rotation about an axis perpendicular to the longitudinal axis of the second end of the arm.

39. The mechanical connection device as claimed in claim 38, wherein the means for giving comprises an elastic ring arranged in the joining piece to be coaxial with the second end of the arm.

40. The mechanical connection device as claimed in claim 38, wherein the joining piece is formed of two assembled parts, configured to be moved or immobilized one with respect to the other.

41. The mechanical connection device as claimed in claim 26, further comprising a connection piece configured to connect to the framework or the bearing structure mounted on the tubular envelope or one arm.

42. The mechanical connection device as claimed in claim 41, wherein the connection piece comprises a connecting part for connecting to a tube or a cable or a stiffener.

43. The mechanical connection device as claimed in claim 42, wherein the connecting part is configured to slide along the tube or the cable or the stiffener.

44. The mechanical connection device as claimed in claim 26, comprising a number of arms each having a first end connected to a fastener mechanically connected to the panel element and a second end connected to one and the same joining piece.

45. The mechanical connection device as claimed in claim 44, wherein the tubular envelope has a connecting part for connecting to a structure, the connecting part incorporating a pivot pin about which the element can pivot with respect to the structure.

46. The mechanical connection device as claimed in claim 45, comprising at least three arms, the first ends of the at least three arms not being aligned.

47. A wall comprising at least one fixed or opening panel element fixed to a structure or a framework by a mechanical connection device as claimed in claim 26.

48. The wall as claimed in claim 47, wherein the panel element or elements are provided at their periphery with at least one gasket of predetermined size filling a space between an element and the structure or between an element and another adjacent element.

49. The wall as claimed in claim 47, wherein the panel elements are equipped with fasteners connected with drillings that may or may not pass through the panel elements.

* * * * *